US006038875A

United States Patent [19]

Haselden

[11] Patent Number: 6,038,875

[45] Date of Patent: Mar. 21, 2000

[54] VAPOR COMPRESSION SYSTEM

[75] Inventor: Geoffrey Gordon Haselden, Leeds, United Kingdom

[73] Assignee: BTG International Inc., Gulph Mills, Pa.

[21] Appl. No.: 09/245,910

[22] Filed: Feb. 8, 1999

Related U.S. Application Data

[63] Continuation of application No. 08/878,556, Jun. 19, 1997, abandoned, which is a continuation of application No. PCT/GB95/02982, Dec. 20, 1995.

[30] Foreign Application Priority Data

| | | | |
|---|---|---|---|
| Dec. 23, 1994 | [GB] | United Kingdom | 9426207 |
| Jun. 20, 1996 | [GB] | United Kingdom | 9612962 |

[51] Int. Cl.[7] ..... F25B 41/04; F25B 43/00

[52] U.S. Cl. ..... 62/218; 62/503; 62/505

[58] Field of Search ..... 62/218, 503, 505

[56] References Cited

U.S. PATENT DOCUMENTS

| | | | |
|---|---|---|---|
| 2,432,859 | 12/1947 | Carter . | |
| 2,986,905 | 6/1961 | Kocher et al. | 62/505 X |
| 3,379,033 | 4/1968 | Grant | 62/505 |
| 3,600,904 | 8/1971 | Tilney | 62/221 |
| 5,027,602 | 7/1991 | Glen | 60/651 |

OTHER PUBLICATIONS

US, A 1 884 186 (Peltier) Oct. 25, 1932 see p. 1, line 35–pg. 2, line 111; FIG. 1–5.

US, A 3 735 603 (Hamilton) May 29, 1973 see col. 2, line 35–col. 5, line 47; FIG. 1,2.

GB, A 1 502 607 (Start Refrigeration) Mar. 1, 1978 see p. 1, line 71–p. 2, line 110; FIG. 1,2.

DE, A 35 45 013 (Audi) Dec. 18, 1986, see p. 9, line 1—p. 10, line 22; FIG. 1.

DE, A 26 02 582 (Schultze) Oct. 13, 1977, see p. 12, last paragraph–p. 17, paragraph 2; FIG. 1–10.

(List continued on next page.)

*Primary Examiner*—William Wayner

*Attorney, Agent, or Firm*—Nixon & Vanderhye

[57] ABSTRACT

A vapor compression system in which a quantity of a refrigerant circulates between at least two pressure levels in a condenser and an evaporator respectively, comprises a compressor (1) for increasing the pressure of refrigerant vapor; a condenser (5) for high pressure refrigerant vapor received from the compressor; an expansion device (13) such as a valve across which the pressure differential between the condenser and the evaporator is maintained, to control the withdrawal of liquid refrigerant from the condenser according to the volume of liquid refrigerant that is within or behind it; an evaporator (15) for liquid refrigerant received from the condenser; a receiver (21) into which refrigerant is discharged from the evaporator, with a vapor withdrawal conduit (25) through which vapor is withdrawn from the receiver for supply to the compressor, the receiver including a reservoir (23) into which liquid refrigerant discharged from the evaporator collects, to control supply of liquid refrigerant to the compressor; a liquid withdrawal conduit (27) through which liquid refrigerant is supplied from the reservoir into the compressor suction of the compressor (1); so arranged that the rate of removal of liquid refrigerant from the reservoir is maintained in proportion to the amount of refrigerant that is removed from the receiver as vapor. The system can ensure that the wetness of the refrigerant discharged into the receiver from the evaporator is controlled to ensure that it is wet under normal operating conditions of the system, to optimize use of heat exchange surfaces of the condenser and the evaporator.

41 Claims, 6 Drawing Sheets

OTHER PUBLICATIONS

US, A 3 370 440 (Kellie) Feb. 27, 1968, see co. 2, line 20—col. 4, line 8; FIG. 1–6.
GB, A 2 164 736 (Tyler Refrigeration) Mar. 26, 1986 see p. 3, line 18—line 79; FIG. 1–3.
US A 2 953 906 (Quick) Sep. 27, 1960, see col. 2, line 24, col. 3, line 48, FIG. 1,2.
US,A 3 111 819 (Williams) Nov. 26, 1963, see col. 1, line 56—col. 3, line 24; FIG. 1–3.
EP A 0 104 750 (Avery) Apr. 4, 1984; see p. 6, line 21—p. 12, line 30; FIG. 2,3.

WO A 92 06339 (Marston) Apr. 16, 1992 cited in the application see p. 14, paragraph 2—p. 19, Paragraph 1; FIG. 1.

DE,A 35 45 013 (Audi) Dec. 18, 1986, see p. 9, line 1—p. 10, line 22; FIG. 1.

VAPOR COMPRESSION SYSTEM

This is a continuation of application Ser. No. 08/878,556, filed Jun. 19, 1997, now abd, which is a continuation of PCT application GB95/02982, filed Dec. 20, 1995.

This patent application claims priority from GB Application 9612962.2 filed Jun. 20, 1996 and is a Continuation-In-Part of PCT Application GB95/02982, of international filing date Dec. 20, 1995.

The present invention relates to vapour compression systems such as might be used in, for example, air conditioners, refrigerators and heat pumps, and to components of vapour compression systems such as condensers, evaporators and expansion devices. The invention addresses issues of control of such systems and components. The systems of the invention are suitable for use with mixtures of mutually soluble refrigerant substances with different boiling points (such that the mixture boils or condenses through a temperature range), and can enable power savings identified through the use of such mixtures to be achieved.

Conventional vapour compression systems comprise an evaporator, a condenser, and a compressor for raising the pressure of refrigerant vapour from that which prevails in the evaporator (where the refrigerant takes in heat) to that which prevails in the condenser (where the refrigerant loses heat). Condensed liquid refrigerant is supplied from the condenser to the evaporator through an expansion device which maintains the pressure difference between the condenser and the evaporator and regulates the flow of refrigerant through the system. In many applications, the components of such systems are assembled together into integrated sealed units.

Particularly when a vapour compression system is required to cool a fluid through a temperature range while rejecting heat to another fluid which warms up through a temperature range, the efficiency of the system can be increased by using a refrigerant which consists of two or more mutually soluble substances which do not form an azeotrope, and can therefore condense or boil over a range of temperatures. The normal boiling points of the two substances are separated by about 15 to 60° C. By appropriate selection of substances for the mixed refrigerant, the changing boiling point of the mixed refrigerant as it condenses can be arranged to follow closely the temperature of the fluid being heated in the condenser throughout the length of the condenser with the refrigerant and heat transfer fluid flowing in counter-current relationship with each other. Similar considerations apply to the evaporator. As a result, less power is required in order to drive the compressor because the pressure ratio required of the compressor is reduced.

It is appropriate for effective operation of a system with mixed refrigerant for the relative proportions of the various components of the mixture to remain substantially constant throughout the system. It is also preferred that the two phases of the refrigerant flow concurrently at least through the evaporator and the condenser, so that the separate phases are each well mixed and there is effective mixing between the phases. This condition can be referred to as equilibrium evaporation or condensation. It can arise for example when liquid and vapour flow cocurrently with vapour flowing down the bore of the channel, and liquid flowing along the walls of the evaporator or the condenser, effectively as a varying thickness film around the flowing vapour. Preferably, the equilibrium conditions of evaporation or condensation are sustained throughout substantially the entire length of the evaporator or condenser (as the case may be). This can be difficult to achieve because the change in phase is accompanied by a large change in volume, which affects the flow condition of the two phases.

A vapour compression system is disclosed in WO-A-92/06339 which incorporates a two-section evaporator which discharges refrigerant into a low pressure receiver. Subject matter disclosed in that document is incorporated in the specification of the present application by this reference. The first (or major) section of the evaporator receives liquid from the condenser through an expansion device, and discharges refrigerant vapour together with a small quantity of liquid into the low pressure receiver, from which vapour is supplied to the compressor. Liquid from the receiver is supplied to the second section of the evaporator and ensures that, under steady state operating conditions of the system, the discharge from the first section of the evaporator remains wet. The system includes a modulating float valve as the expansion device, which opens when the quantity of liquid within or behind it exceeds a predetermined level, the force required to open the valve being substantially independent of the pressure drop across it. The valve ensures that liquid does not accumulate in the condenser and is supplied steadily to the evaporator.

The system disclosed in WO-A-92/06339 operates satisfactorily, enabling the heat exchange surfaces in both evaporator and condenser to be optimally employed independent of the duty required of the system. This enables the power consumption of the compressor to be reduced. It has demonstrated that the power saving advantages of mixed refrigerants (that have long been identified as possible) can be realised.

A two-section evaporator such as is incorporated in the system disclosed in WO-A-92/06339 can be complicated, especially when liquid refrigerant must be distributed amongst an array of separate tubes fed from the receiver, to maintain an appropriate flow rate of refrigerant through the second section of the evaporator. The distribution should be such that each tube in the array is maintained active, even when the load on the system is light.

According to the present invention, it has been found that, in a closed system, the wetness of refrigerant discharged from an evaporator into a receiver can be ensured by the controlled steady removal of a small quantity of liquid refrigerant from the receiver in proportion to the amount of refrigerant that is removed from the receiver as vapour, so as to control the wetness of the refrigerant discharged into the receiver from the evaporator to ensure that it is wet under normal operating conditions of the system.

Accordingly, in one aspect, the invention provides a method of operating a vapour compression system in which a quantity of refrigerant circulates between at least two pressure levels in a condenser and an evaporator respectively, comprising:

(a) a compressor for increasing the pressure of refrigerant vapour;

(b) a condenser for high pressure refrigerant vapour received from the compressor;

(c) an expansion device across which the pressure differential between the condenser and the evaporator is maintained, to control the withdrawal of liquid refrigerant from the condenser according to the volume of liquid refrigerant that is within or behind it;

(d) an evaporator for liquid refrigerant received from the condenser; and (e) a receiver into which refrigerant is discharged from the evaporator, the receiver including:

a reservoir for liquid refrigerant, a vapour withdrawal conduit through which refrigerant vapour is supplied from the receiver to the compressor, and a liquid withdrawal conduit through which liquid refrigerant is supplied from the reservoir to the compressor, e.g. into the compressor suction or into the vapour withdrawal conduit, the method comprising controlling the rate of removal of liquid refrigerant from the receiver in proportion to the amount of refrigerant that is removed from the receiver as vapour, so as to control indirectly the wetness of the refrigerant discharged into the receiver from the evaporator to ensure that it is wet under normal operating conditions of the system.

Removal of a controlled small quantity of liquid refrigerant from the receiver at a steady rate can lead in a closed system to a controlled small degree of wetness in the discharge from the evaporator to replace the withdrawn liquid. This controlled wetness of the discharge can ensure that substantially the entire heat exchange surface of the evaporator remains wet. Accordingly, a high heat transfer coefficient can be maintained along the entire length of the evaporator, substantially independent of the loading placed on the system and on the composition of the refrigerant. Preferably, the rate of removal of liquid from the receiver is such that the wetness of the refrigerant discharged from the evaporator is not more than about 5% by weight, more preferably not more than about 3.5% by weight, e.g. 2–3% by weight or alternatively between about 1 and 2% by weight.

The invention can also ensure that the liquid content of the refrigerant supplied to the compressor is steady without significant short term fluctuations. Any such fluctuations between the liquid content of the evaporator discharge and the liquid injected into the compressor suction can be balanced by the receiver.

In another aspect, the invention provides a vapour compression system in which a quantity of a refrigerant circulates between at least two pressure levels in a condenser and an evaporator respectively, comprising:

(a) a compressor for increasing the pressure of refrigerant vapour;

(b) a condenser for high pressure refrigerant vapour received from the compressor;

(c) an expansion device across which the pressure differential between the condenser and the evaporator is maintained, to control the withdrawal of liquid refrigerant from the condenser according to the volume of liquid refrigerant that is within or behind it;

(d) an evaporator for liquid refrigerant received from the condenser;

(e) a receiver into which refrigerant is discharged from the evaporator, the receiver including a reservoir into which liquid refrigerant discharged from the evaporator collects;

(f) a vapour withdrawal conduit through which vapour is withdrawn from the receiver for supply to the compressor;

(g) a liquid withdrawal conduit through which liquid refrigerant is withdrawn from the reservoir into the compressor; e.g. into the compressor suction or into the vapour withdrawal conduit; and (h) means for controlling the rate of removal of liquid refrigerant from the reservoir in proportion to the amount of refrigerant that is removed from the receiver as vapour, so that refrigerant from the means (h) supplied to the compressor (a) is of such a wetness that under steady-state conditions for a closed system the liquid content of the evaporator discharge will be the same and sufficient for substantially the entire heat exchange surface of the evaporator to remain wet.

Preferably, the receiver is arranged below the compressor suction so that liquid refrigerant contained in the reservoir is retained in the reservoir at shut-down of the system. However the receiver should be mounted only slightly below the compressor suction so that only a small fraction of the available pressure head is used in raising liquid from the receiver to the compressor suction.

With this pressure-drop-driven liquid/vapour-proportioning system injecting into the compressor suction, more of the injected liquid should penetrate into the compression space rather than, if injected further upstream, evaporating in film flow through the suction pipe and manifold.

Furthermore, a larger pressure drop than hitherto can advantageously apply between the receiver and the point of injection.

A system which includes such a receiver with means for removing a controlled quantity of liquid refrigerant into the compressor suction has the advantage that appropriate control of the wetness of the refrigerant supply to the receiver can be achieved without having to include a two-section evaporator. This enables the power consumptions available from use of mixed refrigerants to be obtained, while also minimising equipment costs by avoiding the use of certain complicated multi-section heat exchanger constructions. By appropriate design of the flow resistance of the vapour and liquid withdrawal conduits including their disposition relative to the reservoir, it is possible to ensure that, at steady state operation of the system, the liquid supplied from the receiver to the compressor suction is such that, consequently, the refrigerant discharged from the evaporator to the receiver has an appropriate low degree of wetness. Such operation of the system which keeps all the evaporator surface wet, involves optimum use of the heat exchange surfaces of the evaporator, and can allow the advantages of reduced power consumption from the use of mixed refrigerants to be more fully realised.

A further advantage that arises from the use of the receiver referred to above is that the optimised use of the heat exchange surfaces of the evaporator is achieved without deterioration of the control due to accumulation of compressor oil. This oil is returned to the compressor with the injected liquid refrigerant. This is in contrast to the system disclosed in WO-A-92/06339 in which compressor oil can tend to accumulate excessively in the second evaporator section, especially if the velocity of the refrigerant in the second section drops too low as can happen if the tubes in the second section are not appropriately manifolded. Such accumulation of oil can give rise to operational instability especially when the duty required of the system is reduced or when the system is restarted after a temporary shut-down.

The quantity of liquid refrigerant that is removed from the reservoir is controlled to flow at a substantially steady rate. This rate is preferably determined to be in relation to the quantity of refrigerant that is removed as vapour; this can be achieved by means of so-called proportionating devices.

Provided that the rate of flow of this liquid refrigerant is substantially steady, it has been found that the quantity of liquid, required to be removed from the reservoir and supplied to the compressor need not give rise to mechanical difficulties in operation of the system, or affect adversely the efficiency of the compressor.

Preferably, the receiver is arranged such that not more than about 5% by weight of the compressor throughput of refrigerant passes through the liquid withdrawal conduit, the remainder passing through the vapour withdrawal conduit. More preferably, the liquid withdrawal conduit carries not more than about 4% by weight of the compressor throughput. Preferably, the liquid withdrawal conduit carries at least about 0.5% of the compressor throughput, more preferably at least about 1%. For example, the receiver can be arranged so that about 2% to 3% by weight of the compressor throughput of refrigerant passes through the liquid withdrawal conduit.

Preferably, the opening for vapour to enter the vapour withdrawal conduit for supply to the compressor is located above the level of the refrigerant liquid in the receiver, and is preferably at or towards the top of the receiver. This arrangement has the advantage that it reduces the tendency for liquid refrigerant to be entrained with refrigerant vapour from the reservoir or the discharge from the evaporator or both, and transferred by that route to the compressor suction.

Preferably, the opening for liquid to enter the liquid withdrawal conduit to flow to the compressor suction is located close to the bottom of the receiver, more preferably in the base of the receiver, so that liquid will continue to be drawn from the receiver, even when the level of liquid in the reservoir is low.

The receiver should be mounted so that the maximum liquid level within it is always below the level of the compressor suction so that liquid refrigerant cannot drain into the compressor. The liquid withdrawal line should contain a flow resistance such as a capillary tube or partially opened valve such that under normal operating conditions the pressure drop between the receiver and the compressor suction causes the mass flowrate of liquid refrigerant through the liquid withdrawal line to be a deliberately chosen proportion of the mass flowrate of the vapour going to the compressor, such as 2%. Thus when the vapour flowrate moves above or below the design value the liquid injection rate remains in substantially the same proportion. Moreover this proportionality will not be substantially affected by temperature, pressure or composition changes of the refrigerant.

The reservoir, into which refrigerant is discharged from the first evaporator section, will generally be arranged so that refrigerant collected within it has a large surface area. For example, the surface area of liquid refrigerant may be at least about twice the square of the height of the reservoir, preferably, at least about three times the square of that height. This has the advantage that variation in the amount of liquid refrigerant contained in the reservoir does not affect significantly the depth of the liquid and frothing of the refrigerant in the reservoir is less likely to lead to liquid refrigerant being supplied to the compressor. This allows a significant gap to be maintained between the upper surface of collected liquid refrigerant, and the outlet through which vapour is supplied to the compressor, thus minimising and preferably avoiding the possibility of liquid refrigerant being supplied in bulk to the compressor under any possible operating conditions.

However, with the means for controlling the rate of removal of liquid refrigerant from the reservoir in proportion to the amount of refrigerant that is removed from the receiver as vapour, the liquid may be directly injected into the compressor suction. The advantage is that more of the injected liquid penetrates into the compression space rather than evaporating during film-flow through the suction manifold, and a larger pressure drop, assisting atomisation, can be envisaged between the receiver and the point of injection. As already described, the liquid receiver is mounted below the level of the compressor suction so that the liquid refrigerant does not drain in to the compressor at shut-down.

Scroll, centrifugal, screw and reciprocating compressors can all be used, or more than one (the same or different).

The drop in pressure in the vapour withdrawal conduit between the reservoir and the compressor suction preferably corresponds to a head of liquid refrigerant of between 45 and 200 mm, more preferably between 65 and 160 mm, especially between 80 and 130 mm.

The liquid withdrawal conduit may be configured so that liquid contained in it is placed in heat exchange relationship with liquid refrigerant discharged from the condenser so that it is heated by the said liquid refrigerant, between discharge into the conduit from the reservoir and discharge from the conduit into the vapour withdrawal conduit. In this construction, the liquid withdrawal conduit includes a constriction in it, by which flow of refrigerant along the conduit is controlled. It will be preferred for this refrigerant stream to flow generally upwardly while in heat exchange relationship with the condensate.

Examples of materials which are suitable for use as refrigerants in a single refrigerant system include those designated by the marks R22 and R134a. A particular advantage of the system of the invention is that it is well suited to the use of wide boiling non-azeotropic mixed refrigerants in which it is particularly desirable that, at all places within the condenser and the evaporator, liquid and vapour refrigerant flow together concurrently and are in equilibrium, whilst the refrigerant mixture flows essentially counter-currently with the fluid with which it is exchanging heat. This objective can be achieved by the system of the invention, particularly when it includes both an expansion valve where the force required to open it is substantially independent of the pressure drop across it. The vapour compression system of the invention therefore makes possible the power saving which is available from the use of wide boiling mixed refrigerants. In addition, further power saving can be achieved because of the ability of the system of the invention to adapt to varying duty, start-up conditions, varying ambient conditions and so on, while operating at optimum efficiency. Examples of suitable mixed refrigerants include those designated by the marks R23/R134a and R32/R227. Suitable mixtures of refrigerant substances can have boiling points separated by at least about 10° C., for example at least about 20° C. The difference in boiling points will often be less than about 70° C., preferably less than about 60° C., for example less than about 50° C.

It will be understood that the term "refrigerant", used in this document to denote the fluid circulating in the vapour compression system, is applicable to the fluid which circulates in systems which function as air conditioners or heat pumps.

The duty performed by the vapour compression system is determined by appropriate adjustment of the flow rate of the refrigerant vapour through the system. This can be achieved in a number of ways: for example, the throughput of the compressor can be adjusted, for example by adjustment of its speed or by unloading one or more cylinders, or more than one compressor may be provided of which some or all may be used according to the quantity of refrigerant required to be circulated. Alternatively, the desired duty may be obtained by selectively switching the compressor on and off as necessary.

The control of the compressor throughput may be in response to a detected change in temperature in the medium required to be heated or cooled by the system. For example, in a refrigeration system, a temperature sensor may be used to cause the throughput of a compressor to increase on detecting an increase in temperature of a cold chamber.

When air is used as the heat transfer medium in the condenser or the evaporator, and in cases where the duty of the unit varies widely, variable output fans may be used to modulate air flow and to conserve power.

The present invention will now be described, by way of example only, with reference to the accompanying drawings, in which.

Figure 1:
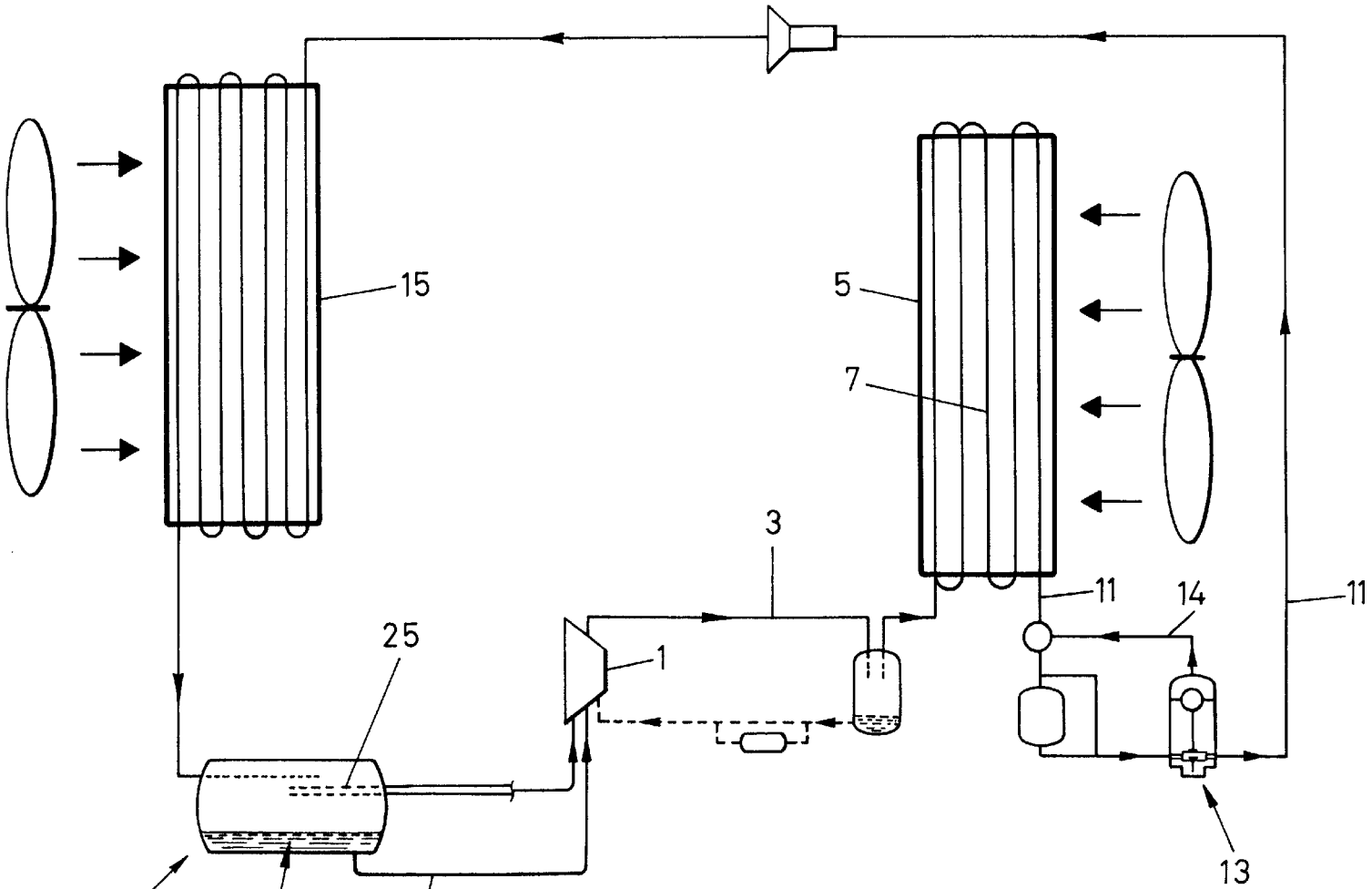
FIG. 1 is a schematic illustration of a vapour compression system in accordance with the present invention.

Referring to the drawings, FIG. 1 shows a vapour compression system which comprises a compressor 1 for increasing the pressure of refrigerant vapour, and for forcing the vapour through a first conduit 3 to a condenser 5. The condenser 5 comprises an array of condenser tubes 7, connected both in series and in parallel, which are attached to a plurality of fins which facilitate heat transfer between a cooling medium (such as air) which flows over the fins and the hot refrigerant contained within the condenser tube. The cooling medium is conveniently external air when the system forms part of an air conditioning unit or a refrigerator. The flow directions of the two fluids are essentially countercurrent so this design is suitable for mixed refrigerants as well as pure refrigerants.

Refrigerant is discharged from the condenser 5 into a second conduit 11 through a valve 13. A vapour return tube 14 is provided to ensure that the inlet to the valve 13 does not become vapour locked. The valve is arranged to open when the quantity of the condensed liquid refrigerant behind or within it exceeds a predetermined level. The construction of an appropriate valve is disclosed in WO-A-92/06339. An appropriate valve will be one in which the force required to open it is substantially independent of the pressure drop across it.

The condensed liquid refrigerant from the condenser passes to an evaporator 15 through the valve 13 and the second conduit 11. The evaporator 15 comprises an array of tubes connected both in series and in parallel. It further comprises evaporator fins over which a fluid to be refrigerated flows, so as to transfer heat and to cause the refrigerant to evaporate. The fluid is cooled as a result. The fluid might be, for example, air in a room when the refrigeration system forms part of an air conditioning unit.

The refrigerant is discharged from the evaporator 15 into a receiver 21. Liquid refrigerant discharged from the evaporator collects in the reservoir 23 of the receiver which can provide buffer storage of the liquid refrigerant. A vapour withdrawal conduit 25 extends from the top of the reservoir 23, to convey the major part of the refrigerant as vapour (that is, essentially liquid-free vapour) from the reservoir to the compressor. It will therefore be understood that refrigerant can be separated in the receiver, into liquid and vapour phases.

The receiver includes a liquid withdrawal conduit 27 through which liquid refrigerant is supplied from the reservoir into the compressor suction of the compressor 1. The layout, diameter and length of the vapour withdrawal conduit 25 will be designed to minimise the pressure drop experienced by the vapour, which will normally be equivalent to a liquid refrigerant head of at least 100 mm (corresponding to about 1.3 kPa). If the pressure drop is significantly lower than this, additional flow resistance should be added to raise the total pressure drop to about this value. The layout and dimensions of the liquid withdrawal conduit are now designed so that with the pressure drop across it caused by the pressure drop in the vapour conduit, the mass flowrate of liquid refrigerant is a chosen small proportion, say 2%, of the mass flowrate of the refrigerant vapour. Thus the receiver coupled to the vapour and liquid conduits provides a flow proportionating device to feed the compression suction with a refrigerant stream of controlled wetness substantially independent of the duty.

The evaporator, receiver and flow proportioning means in combination ensure that all of the evaporator surface is employed for heat transfer, irrespective of the duty required of the system. (When the system is running, the arrangement of vapour and liquid withdrawal conduit in the receiver will ensure that liquid is drawn from the reservoir at a controlled rate. Consequently, the level of liquid in the reservoir will tend to go down.) The use of an expansion device which opens when the quantity of condensed liquid refrigerant within or behind it reaches a predetermined level ensures that liquid cannot accumulate anywhere in the system other than in the reservoir, because the expansion device ensures that liquid does not accumulate in the condenser. Liquid is admitted to the evaporator from the condenser at the rate at which it is produced in the condenser. The system will therefore tend towards a steady state condition in which the liquid refrigerant removed from the reservoir by means of the liquid withdrawal conduit is exactly compensated by the liquid component of the two phase refrigerant discharged into the reservoir from the evaporator. The pressure in the evaporator will adjust itself automatically to achieve this balance. This means that all of the evaporator surface must be wet during such steady state operation.

Figure 2:
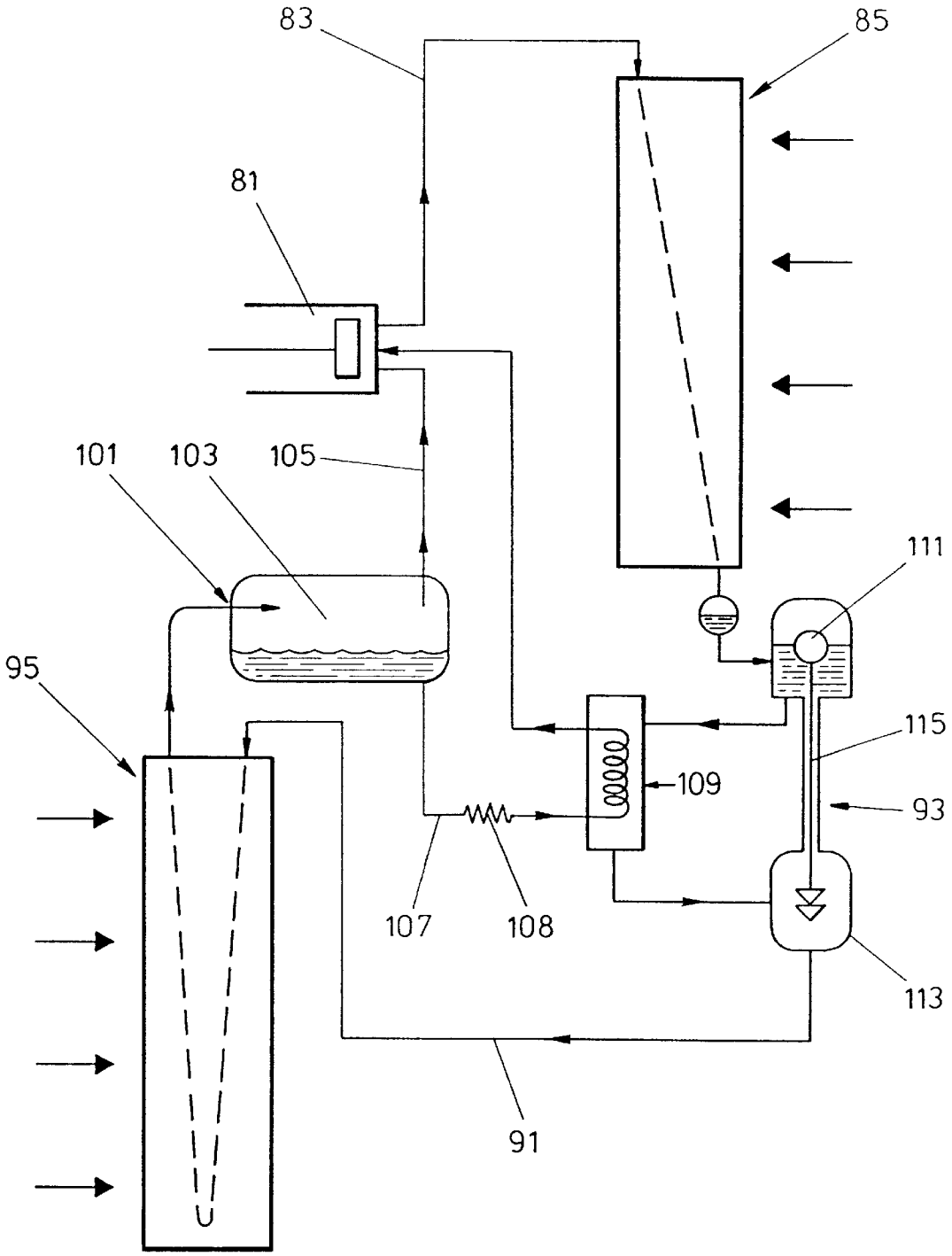
FIG. 2 is a schematic illustration of another vapour compression system in accordance with the present invention.

FIG. 2 shows a vapour compression system which comprises a compressor 81 for increasing the pressure of refrigerant vapour, and for forcing the vapour through a first conduit 83 to a condenser 85. Refrigerant is discharged from the condenser into a second conduit 91 through a valve 93. A vapour return tube can be provided to ensure that the inlet to the valve does not become vapour locked. The valve is arranged to open when the quantity of the condensed liquid refrigerant behind or within it exceeds a predetermined level.

The refrigerant from the condenser passes through an evaporator 95 through the valve 93 and the second conduit 91. The refrigerant is discharged from the evaporator 95 into a receiver 101. Liquid refrigerant discharged from the evaporator collects in the reservoir 103 of the receiver. A vapour withdrawal conduit 105 extends from the top of the reservoir, and to convey the major part of the refrigerant as vapour from the reservoir to the compressor.

The receiver includes a liquid withdrawal conduit 107 through which liquid refrigerant is supplied from the reservoir into the vapour withdrawal conduit. The liquid conduit includes a constriction 108 which provides a resistance to flow. Liquid refrigerant in the conduit 107 is exposed to heat imparted by liquid refrigerant that is discharged from the condenser as it flows generally upwardly through a heat exchanger 109 (such that the point of entry to the heat exchanger is lower than the point of exit) so that the liquid refrigerant is evaporated, at least partially, on its way to the compressor suction.

The valve 93 comprises a float 111 which is exposed to saturated liquid refrigerant from the condenser, and valve orifices 113 which are exposed to liquid refrigerant that has been sub-cooled by passage through the heat exchanger 109. The float 111 and the needles by which the valve orifices are closed are connected by an elongate rod 115 in a close fitting tube which are such that the flow of liquid that is permitted between the float chamber and the valve orifices through the resulting annular passage is negligible. Accordingly, saturated refrigerant condensate is caused to flow from the base of the float chamber, through the heat exchanger, into the valve body, where it expands through the orifices of the valve.

The evaporator, receiver and flow proportioning means in combination ensure that all of the evaporator surface is effectively employed for heat transfer, irrespective of the duty required of the system. When the system is running, the arrangement of vapour and liquid withdrawal conduits in the receiver will ensure that liquid is drawn from the reservoir at a controlled rate. Consequently, the level of liquid in the reservoir will tend to go down. The use of an expansion device which opens when the quantity of condensed liquid refrigerant within or behind it reaches a predetermined level ensures that liquid cannot accumulate anywhere in the system other than in the reservoir, because the expansion device ensures that liquid does not accumulate in the condenser. The system will therefore tend towards a steady state condition in which the liquid refrigerant removed from the reservoir by means of the liquid withdrawal conduit is exactly compensated by the liquid component of two phase refrigerant discharged into the reservoir from the evaporator. The pressure in the evaporator will adjust itself automatically to achieve this balance. This means that all of the evaporator surface must be wet during such steady state operation.

Figure 3:
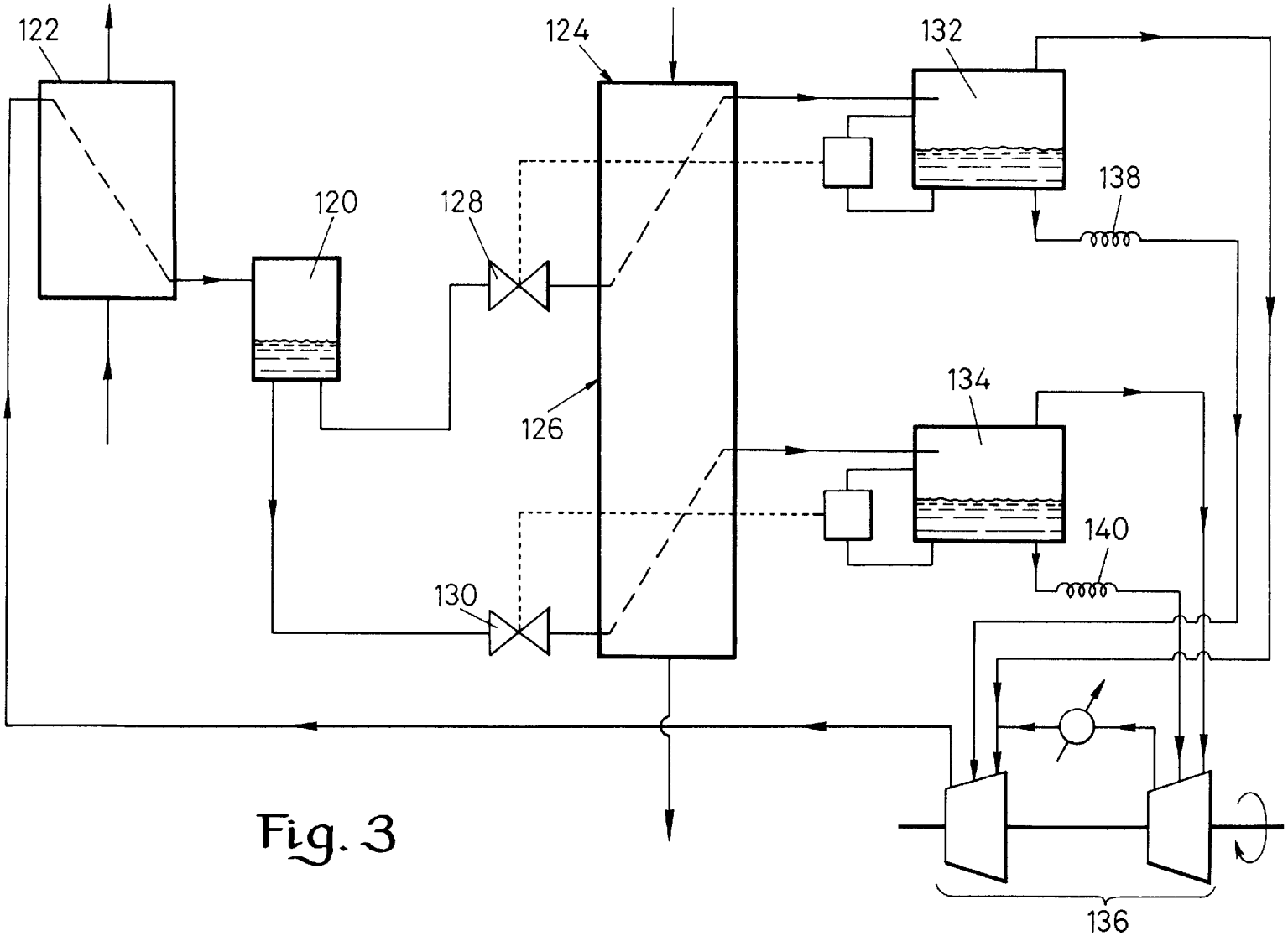
FIG. 3 is a schematic illustration of a vapour compression system in which condensed refrigerant is split into two streams which are split between two evaporators.

FIG. 3 shows a system which can accommodate a temperature change in the evaporator which is significantly greater than that in the condenser, for example by as much as a factor of two or more. For example, the temperature change across the condenser might be about 10° C. (between say 19 and 29° C.), while the temperature change across the evaporator might be about 22° C; (in two stages from say 27 to 16° C. and 16 to 5° C.).

The system includes a receiver 120 into which liquid is discharged from the condenser 122. Liquid from the reservoir is split between two streams which supply refrigerant into first and second evaporators 124, 126. Flow of refrigerant into the evaporators is controlled by means of valves 128, 130 which are designed to maintain steady levels in receivers 132 and 134.

Refrigerant is discharged from the evaporators into respective receivers 132, 134, in liquid and vapour phases, from which refrigerant vapour is withdrawn for supply to the compressor assembly 136. The compressor assembly 136 comprises two separate compressors, which operate at high and low pressures respectively. The use of two compressors in this way facilitates operation of the two evaporators of the system over different temperature profiles. The components are arranged so that the receiver can hold all of the free refrigerant in the system when the reservoirs do not hold any. The reservoirs are sufficiently large that they can hold liquid refrigerant without frothing into the compressor. The reservoirs also supply liquid refrigerant in small controlled quantities to the compressor stages of the assembly 136 through liquid withdrawal conduits 138, 140 which feed to the respective compressor suction stages in the manner described above.

The valves 128, 130 are controlled by level sensors for liquid in the reservoirs.

Turning now to the remaining drawings, in which corresponding parts bear the same reference numerals as in FIGS. 1 to 3, FIG. 4 shows a vapour compression system operating generally the same as in FIG. 1, differing in particular when the refrigerant is discharged from the evaporator 15 into the receiver 21. The vapour withdrawal conduit 25 extends from the top of the reservoir 23, to convey the major part of the refrigerant as vapour (that is, essentially liquid-free vapour) from the reservoir to the compressor.

The receiver includes a liquid withdrawal conduit 27 through which liquid refrigerant is supplied from the reservoir into the vapour withdrawal conduit 25. By selection of its diameter and length, taking into account restrictions to flow such as are provided by bends, the vapour withdrawal conduit is arranged so that the pressure of vapour flowing in is reduced at a point downstream of the reservoir related to the pressure in the reservoir, so that liquid refrigerant in the reservoir is drawn into the vapour withdrawal conduit 25 through the liquid withdrawal conduit 27 at a rate proportional to the vapour flow. The pressure drop corresponds approximately to a head of liquid refrigerant of about 100 mm.

The evaporator, receiver and flow proportioning means in combination ensure that all of the evaporator surface is employed for heat transfer, irrespective of the duty required of the system.

Figure 5:
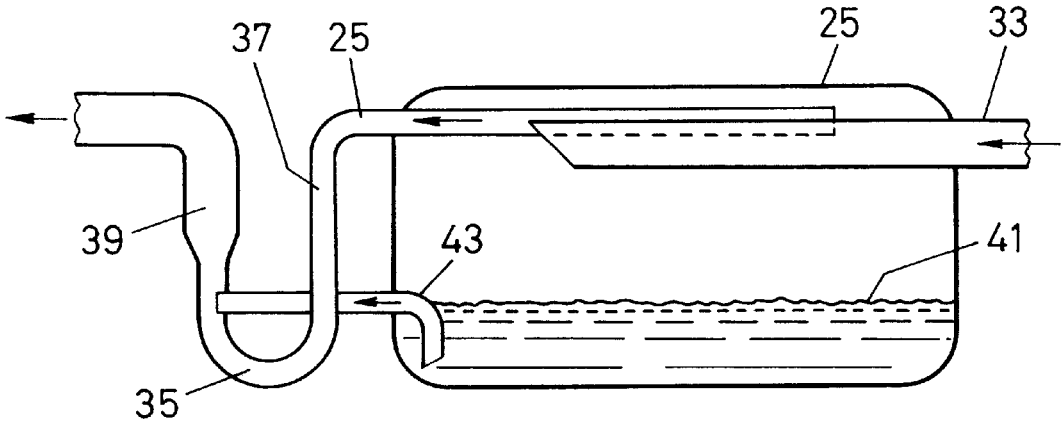
FIG. 5 is a schematic illustration of a receiver suitable for use in the vapour compression system shown in FIG. 4.
Figure 6:
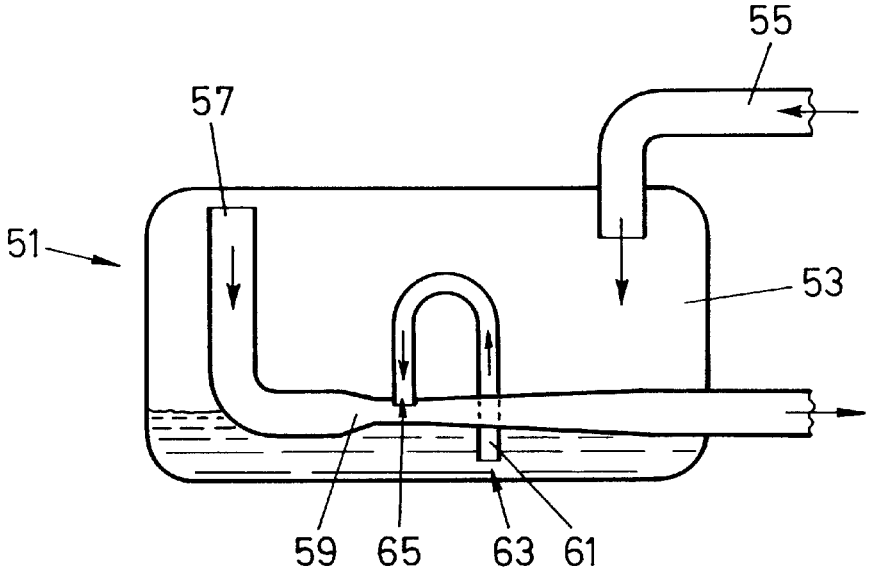
FIG. 6 is a schematic illustration of another embodiment of a receiver.

FIGS. 5 and 6 show constructions of receivers in more detail. Referring first to FIG. 5, in which the disclosed construction comprises a reservoir 31, into which refrigerant is discharged from the evaporator through a discharge conduit 33. The outlet from the discharge conduit is located towards the top of the reservoir 31. The vapour withdrawal conduit 25 from which the refrigerant vapour is supplied from the reservoir 31 to the compressor is located towards the top of the reservoir.

The vapour withdrawal conduit 25 has a U-shaped portion 35 immediately downstream of the reservoir 31. The U-shaped portion comprises first and second limbs 37, 39 and a connecting base portion. The base portion is located at a level well below the normal level 41 of liquid refrigerant contained in the reservoir 31 when the system is running in a steady state condition.

The second limb 39 of the U-shaped portion of the vapour withdrawal conduit is flared.

A liquid withdrawal conduit 43 extends from the base of the reservoir 31 (well below the normal liquid level 41) and joins the second limb 39 of the U-shaped portion of the vapour withdrawal conduit. The junction between the liquid and vapour withdrawal conduits 25, 43 is at a point just upstream of the flare in the vapour withdrawal conduit. The opening from the liquid withdrawal conduit into the vapour withdrawal conduit discharges liquid refrigerant into the vapour withdrawal conduit at a point about one third of the distance across the vapour withdrawal conduit, so that the liquid refrigerant discharged into the vapour will tend to atomise as it is discharged.

The liquid withdrawal conduit 43 is provided by a capillary tube. The diameter and length of the capillary tube are selected so that, for a rate of liquid injection into the vapour withdrawal conduit 25 at the desired ratio (for example about 2% by weight of the throughput of refrigerant through the compressor), the pressure drop across the liquid withdrawal conduit is equal to the pressure drop in the vapour withdrawal conduit 25. The junction between the vapour and liquid withdrawal conduits is at a level that is at about or slightly above the level of liquid refrigerant in the reservoir when the system is in steady state operation.

FIG. 6 shows an alternative construction of receiver 51. It comprises a reservoir 53 into which refrigerant is discharged from the evaporator through a conduit 55.

A vapour withdrawal conduit 57 has an opening towards the top of the reservoir for entry of vapour for supply to the compressor. The vapour withdrawal conduit includes a downwardly extending portion and a portion which extends approximately parallel to the surface of liquid refrigerant contained in the reservoir, at about the level of liquid when the system is running in a steady state condition.

A constriction in the vapour withdrawal conduit provides a venturi 59, by which the pressure of the vapour in the vapour withdrawal conduit is decreased and then increased.

A liquid withdrawal conduit 61 is provided in the form of an n-shaped tube, with its opening 63 for entry of liquid located towards the base of the reservoir 53.

The opening 65 for discharge of liquid refrigerant into the vapour withdrawal conduit 57 is located relative to the venturi 59 such that liquid refrigerant is drawn from the reservoir 53 into the vapour withdrawal conduit through the liquid withdrawal conduit as a result of the pressure changes imposed on vapour in the vapour withdrawal conduit by the venturi.

The quantity of liquid that is drawn into the vapour withdrawal conduit is controlled at least partially by the dimensions of the venturi.

Figure 4:
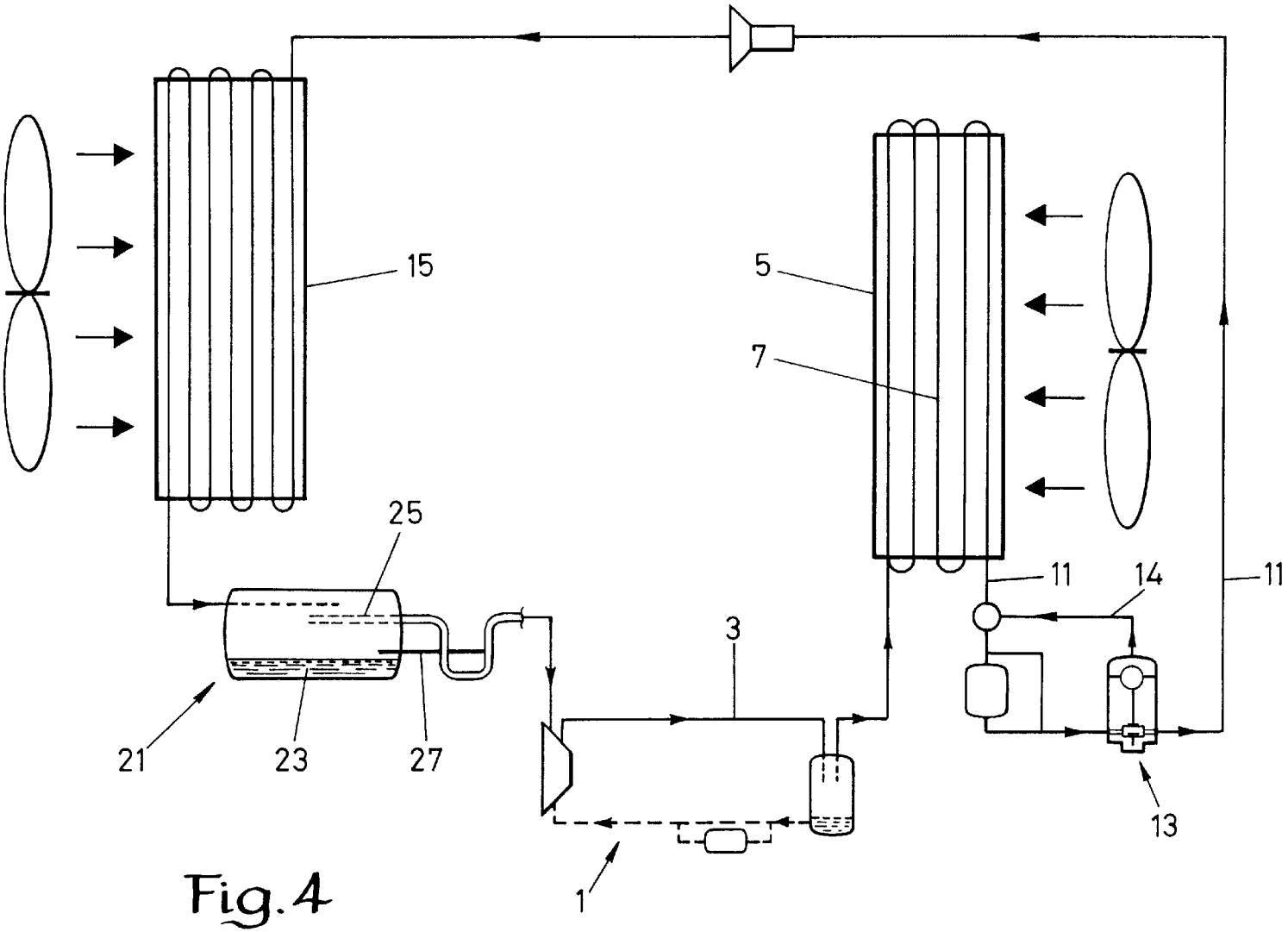
FIG. 4 is a schematic illustration of a variant vapour compression system, still in accordance with the present invention.
Figure 7:
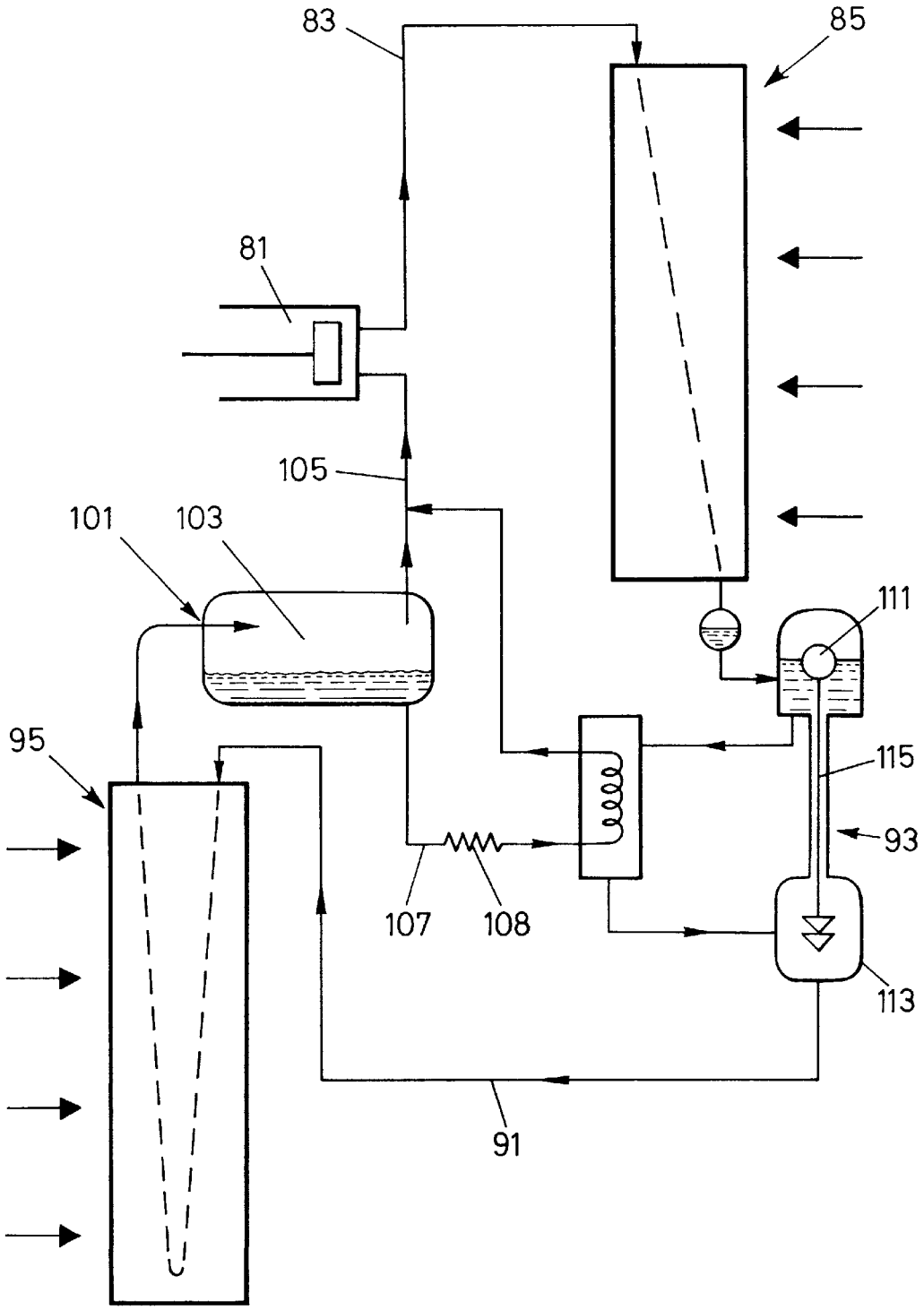
FIG. 7 is a schematic illustration of another vapour compression system in accordance with the present invention.

FIG. 7 shows a vapour compression system similar to that of FIG. 4, but note that the liquid withdrawal conduit 107 through which liquid refrigerant is supplied from the reservoir feeds into the vapour withdrawal conduit 105 upstream of the compressor 81.

I claim:

1. A vapour compression system in which a quantity of a refrigerant circulates between at least two pressure levels in a condenser and an evaporator respectively, comprising:

(a) a compressor for increasing the pressure of refrigerant vapour;

(b) a condenser for high pressure refrigerant vapour received from the compressor;

(c) an expansion device across which the pressure differential between the condenser and the evaporator is maintained, to control the withdrawal of liquid refrigerant from the condenser according to the volume of liquid refrigerant that is within or behind it;

(d) an evaporator for liquid refrigerant received from the condenser;

(e) a low pressure receiver into which refrigerant is discharged from the evaporator, the receiver including a reservoir into which liquid refrigerant discharged from the evaporator collects;

a vapour withdrawal conduit through which vapour is withdrawn from the receiver for supply to the compressor;

(g) a liquid withdrawal conduit through which vapour is withdrawn from the reservoir into the compressor; and (h) means for controlling the rate of removal of liquid refrigerant from the reservoir in proportion to the amount of refrigerant that is removed from the receiver as vapour, so that under steady conditions the total flow of refrigerant from the means (h) supplied to the compressor (a) will have a controlled wetness, and being a closed system the liquid content of the evaporator discharge will have the same wetness which can be sufficient to ensure that substantially the entire heat exchange surface of the evaporator remains wet.

2. A vapour compression system as claimed in claim 1, in which the receiver is arranged so that liquid refrigerant is retained in the reservoir at shut-down of the system.

3. A vapour compression system as claimed in claim 1, in which the configuration of the vapour withdrawal conduit and the configuration of the liquid withdrawal conduit are determined such that the pressure drop in the vapour withdrawal conduit between the reservoir and the compressor suction provides a controlled flow of liquid along the liquid withdrawal conduit from the receiver to the compressor suction at a desired rate.

4. A vapour compression system as claimed in claim 3, in which the cross-sectional configuration of the vapour withdrawal conduit varies along its length.

5. A vapour compression system as claimed in claim 1, in which the compressor suction is above the level of liquid refrigerant in the reservoir when the system is at steady state operation.

6. A vapour compression system as claimed in claim 4, in which the vapour withdrawal conduit has a constriction in it.

7. A vapour compression system as claimed in claim 1, in which the liquid withdrawal conduit includes a section that is a capillary or other flow resistance.

8. A vapour compression system as claimed in claim 1, in which the liquid withdrawal conduit is configured so that liquid contained in it is placed in heat exchange relationship with liquid refrigerant discharged from the condenser so that the liquid withdrawal conduit and its contents are heated.

9. A vapour compression system as claimed in claim 8, in which the liquid withdrawal conduit includes a constriction in it, by which flow of refrigerant along the conduit is controlled.

10. A vapour compression system as claimed in claim 8, in which the opening into the liquid withdrawal conduit for liquid from the receiver is located in the base of the reservoir.

11. A vapour compression system as claimed in claim 8, in which refrigerant flows generally upwardly while in heat exchange relationship with the condensate.

12. A vapour compression system as claimed in claim 1, in which the means for controlling the rate of removal of liquid refrigerant from the receiver is arranged such that the wetness of the refrigerant discharged from the evaporator into the receiver is not more than about 5%, preferably not more than about 3.5%.

13. A vapour compression system as claimed in claim 1, which includes a refrigerant which consists of two or more mutually soluble refrigerant substances which do not form an azeotrope.

14. A vapour compression system as claimed in claim 1, which includes two evaporators arranged to cool a fluid in sequence, through successive temperature ranges.

15. A vapour compression system as claimed in claim 14, which includes respective reservoirs, into which refrigerant is discharged from the evaporators.

16. A vapour compression system as claimed in claim 15, which includes valves for controlling the flow of fluid between the evaporators, the valves being controlled according to the level of liquid refrigerant in the reservoirs.

17. A vapour compression system according to claim 1, wherein the compressor is a scroll, centrifugal, screw or reciprocating compressor, or wherein more than one such compressor, the same or different, is used.

18. A vapour compression system according to claim 1, wherein the liquid withdrawal conduit supplies the compression suction.

19. A vapour compression system according to claim 1 wherein the liquid withdrawal conduit feeds into the vapour withdrawal conduit.

20. A vapour compression system as claimed in claim 19, in which the vapour withdrawal conduit is arranged so that the pressure of vapour flowing in it is reduced at a point downstream of the reservoir relative to the pressure in the reservoir, so that liquid refrigerant in the reservoir is drawn into the vapour withdrawal conduit through the liquid withdrawal conduit.

21. A vapour compression system as claimed in claim 20, in which the configuration of the vapour withdrawal conduit and the configuration of the liquid withdrawal conduit are selected such that the pressure drop in the vapour withdrawal conduit between the reservoir and the junction with the liquid withdrawal conduit provides a controlled flow of liquid along the liquid withdrawal conduit from the reservoir to the said junction.

22. A vapour compression system as claimed in claim 21, in which the cross-sectional configuration of the vapour withdrawal conduit differs between the portions upstream and downstream respectively of the junction with the liquid withdrawal conduit.

23. A vapour compression system as claimed in claim 20, in which the junction between the vapour and liquid withdrawal conduits is at a level that is about or slightly above the level of liquid refrigerant in the reservoir when the system is at steady state operation.

24. A vapour compression system as claimed in claim 23, in which the opening from the liquid withdrawal conduit into the vapour withdrawal conduit discharges liquid refrigerant into the vapour withdrawal conduit at a point at least about one third of the distance across the vapour withdrawal conduit.

25. A vapour compression system as claimed in claim 20, in which the vapour withdrawal conduit has a constriction in it.

26. A vapour compression system as claimed in claim 25, in which the said constriction provides a venturi.

27. A vapour compression system as claimed in claim 20, in which the liquid withdrawal conduit includes an n-shaped portion with two limbs and a connecting portion extending between them, in which liquid is drawn from the reservoir and made to flow initially upwardly from the reservoir along a first one of the limbs, and downwardly to the junction with the vapour flow conduit along the other of the limbs.

28. A vapour compression system as claimed in claim 20, in which the liquid withdrawal conduit includes a section that is a capillary or other flow resistance.

29. A vapour compression system as claimed in claim 20, in which the opening for vapour to enter the vapour withdrawal conduit is at or towards the top of the reservoir, and in which the vapour withdrawal conduit includes a section which extends downwardly to a level below the level of liquid in the reservoir when the system is in operation.

30. A vapour compression system as claimed in claim 29, in which the vapour withdrawal conduit includes a U-shaped portion with two limbs and a connecting portion extending between them, in which the upstream limb of the U-shaped portion provides the said downwardly extending section.

31. A vapour compression system as claimed in claim 30, in which the junction between the vapour withdrawal conduit and the liquid withdrawal conduit is located in the downstream limb of the U-shaped portion of the vapour withdrawal conduit.

32. A vapour compression system as claimed in claim 31, in which the junction between the vapour withdrawal conduit and the liquid withdrawal conduit is located at approximately the level of liquid in the reservoir when the system is in operation.

33. A method of operating a vapour compression system in which a quantity of a refrigerant circulates between at least two pressure levels in a condenser and an evaporator respectively, said system comprising:

(a) a compressor for increasing the pressure of refrigerant vapour;

(b) a condenser for high pressure refrigerant vapour received from the compressor;

(c) an expansion device across which the pressure differential between the condenser and the evaporator is maintained, to control the withdrawal of liquid refrigerant from the condenser according to the volume of liquid refrigerant that is within or behind it;

(d) an evaporator for liquid refrigerant received from the condenser; and (e) a low pressure receiver into which refrigerant is discharged from the evaporator, the receiver including:
a reservoir for liquid refrigerant;
a vapour withdrawal conduit through which refrigerant vapour is supplied from the receiver to the compressor, and
a liquid withdrawal conduit through which liquid refrigerant is supplied from the receiver into the compressor, the method comprising controlling the rate of removal of liquid refrigerant from the receiver in proportion to the amount of refrigerant that is removed from the receiver as vapour, so as to control indirectly the wetness of the refrigerant discharged into the receiver from the evaporator to ensure that it is wet under normal operating conditions of the system.

34. A method as claimed in claim 33, in which the liquid withdrawal conduit feeds into the vapour withdrawal conduit and the vapour withdrawal conduit is arranged so that the pressure of vapour flowing in it is reduced at a point downstream of the reservoir relative to the pressure in the reservoir, so that liquid refrigerant in the receiver is drawn into the compressor through the liquid withdrawal conduit.

35. A method as claimed in claim 33, in which the liquid withdrawal conduit is configured so that liquid contained in it is placed in heat exchange relationship with liquid refrigerant discharged from the condenser so that the liquid withdrawal conduit and its contents are heated by the said liquid refrigerant discharged from the condenser.

36. A method as claimed in claim 33, which is operated using a refrigerant which consists of two or more mutually soluble refrigerant substances which do not form an azeotrope.

37. A method according to claim 33, in which the liquid withdrawal conduit feeds into the compressor suction.

38. A vapour compression system in which a quantity of a refrigerant circulates between at least two pressure levels in a low pressure condenser and an evaporator respectively, comprising:

(a) a compressor for increasing the pressure of refrigerant vapour;

(b) a condenser for high pressure refrigerant vapour received from the compressor;

(c) an expansion device across which the pressure differential between the condenser and the evaporator is maintained, to control the withdrawal of liquid refrigerant from the condenser according to the volume of liquid refrigerant that is within or behind it;

(d) an evaporator for liquid refrigerant received from the condenser;

(e) a receiver into which refrigerant is discharged from the evaporator, the receiver including:

a reservoir for liquid refrigerant;

a vapour withdrawal conduit through which refrigerant vapour is supplied from the receiver to the compressor, and a liquid withdrawal conduit through which liquid refrigerant is withdrawn from the receiver and supplied into the vapour withdrawal conduit, the vapour withdrawal conduit being arranged so that the pressure of vapour flowing in it is reduced at a point downstream of the receiver relative to the pressure in the receiver, so that liquid refrigerant in the receiver is drawn into the vapour withdrawal conduit through the liquid withdrawal conduit.

39. A system as claimed in claim 38 wherein the liquid withdrawal conduit is arranged such that liquid refrigerant is supplied to the vapour withdrawal conduit at a point above the liquid level in the receiver.

40. A vapour compression system in which a quantity of a refrigerant circulates between at least two pressure levels in a condenser and an evaporator respectively, comprising:

(a) a compressor for increasing the pressure of refrigerant vapour;

(b) a condenser for high pressure refrigerant vapour received from the compressor;

(c) an expansion device across which the pressure differential between the condenser and the evaporator is maintained, to control the withdrawal of liquid refrigerant from the condenser;

(d) an evaporator for liquid refrigerant received from the condenser;

(e) a low pressure receiver into which refrigerant is discharged from the evaporator, the receiver including:

a reservoir for liquid refrigerant;

a vapour withdrawal conduit through which refrigerant vapour is supplied from the receiver to the compressor, and a liquid withdrawal conduit through which liquid refrigerant is withdrawn from the receiver and supplied into the compressor, the liquid withdrawal conduit being configured so that liquid contained in it is placed in heat exchange relationship with liquid refrigerant discharged from the condenser so that the liquid withdrawal conduit and its contents are heated by the said liquid refrigerant.

41. A vapour compression system as claimed in claim 40, which is arranged so that the wetness of the refrigerant discharged from the evaporator into the receiver is not more than about 5%, preferably not more than about 3.5%.

* * * * *